US011257438B2

(12) United States Patent
Kim et al.

(10) Patent No.: US 11,257,438 B2
(45) **Date of Patent: *Feb. 22, 2022**

(54) DISPLAY DEVICE AND METHOD OF DRIVING THE SAME

(71) Applicant: Samsung Display Co., Ltd., Yongin-si (KR)

(72) Inventors: Tae Jin Kim, Hwaseong-si (KR); Gyu Su Lee, Asan-si (KR); Myung Ho Lee, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/325,157

(22) Filed: May 19, 2021

(65) Prior Publication Data

US 2021/0272522 A1 Sep. 2, 2021

Related U.S. Application Data

(63) Continuation of application No. 16/418,937, filed on May 21, 2019, now Pat. No. 11,037,499.

(30) Foreign Application Priority Data

Jul. 5, 2018 (KR) ..... 10-2018-0078011

(51) Int. Cl.
*G09G 3/3266* (2016.01)
*G09G 3/3258* (2016.01)
(Continued)

(52) U.S. Cl.
CPC ..... *G09G 3/3266* (2013.01); *G09G 3/3258* (2013.01); *G09G 3/3275* (2013.01);
(Continued)

(58) Field of Classification Search
CPC ... G09G 3/30–3291; G09G 2300/0426; G09G 2300/043; G09G 2300/0819;
(Continued)

(56) References Cited

U.S. PATENT DOCUMENTS 9,754,536 B2 9/2017 Chang et al.
10,032,414 B2 7/2018 Kim et al.
(Continued)

FOREIGN PATENT DOCUMENTS

EP 2889861 7/2015
EP 2983165 2/2016
(Continued)

OTHER PUBLICATIONS

Extended European Search Report issued in European Patent Application No. 19184155.0 (dated Aug. 10, 2019).
(Continued)

*Primary Examiner* — David Tung
(74) *Attorney, Agent, or Firm* — H.C. Park & Associates, PLC

(57) ABSTRACT

A display device includes a display part including an organic light emitting diode (OLED) connected to a pixel circuit connected to a scan line and a sensing scan line, a signal generator configured to generate at least one display output enable (OE) signal during an image display period; and generate at least one sensing OE signal during a sensing period; and a scan driver including a display scan signal terminal connected to the scan line and a sensing scan signal terminal connected to the sensing scan line, wherein the scan driver is configured to: generate a scan signal for turning on the switching transistor in response to the display OE signal during the image display period; and generate a sensing scan signal for turning on the sensing transistor in response to the sensing OE signal during the sensing period.

10 Claims, 10 Drawing Sheets

(51) Int. Cl.
*G09G 3/3275* (2016.01)
*G09G 3/3233* (2016.01)
*G09G 3/3208* (2016.01)

(52) U.S. Cl.
CPC ..... *G09G 2300/0426* (2013.01); *G09G 2310/0243* (2013.01); *G09G 2310/08* (2013.01); *G09G 2320/045* (2013.01)

(58) Field of Classification Search
CPC ... G09G 2300/0842; G09G 2310/0243; G09G 2310/08; G09G 2310/0262; G09G 2320/043; G09G 2320/045; G09G 2320/0819; G09G 2320/0295; G09G 2330/00
See application file for complete search history.

(56) References Cited

U.S. PATENT DOCUMENTS

2014/0176401 A1* 6/2014 Kim ..... G09G 3/3208 345/76
2015/0049075 A1* 2/2015 Lim ..... G09G 5/397 345/212
2015/0179105 A1 6/2015 Mizukoshi
2016/0012800 A1* 1/2016 Han ..... G09G 3/3233 345/213
2017/0193899 A1* 7/2017 Yoon ..... G09G 3/3233
2018/0114815 A1* 4/2018 Lee ..... H01L 51/50

FOREIGN PATENT DOCUMENTS

EP 3040983 7/2016
KR 10-1834012 3/2018

OTHER PUBLICATIONS

EP Summons to attend Oral Proceedings dated May 6, 2021, in EP Application No. 19184155.0.
Non-Final Office Action dated Jul. 21, 2020, in U.S. Appl. No. 16/418,937.
Final Office Action dated Nov. 10, 2020, in U.S. Appl. No. 16/418,937.
Notice of Allowance dated Feb. 9, 2021, in U.S. Appl. No. 16/418,937.
Corrected Notice of Allowance dated May 19, 2021, in U.S. Appl. No. 16/418,937.

* cited by examiner

DISPLAY DEVICE AND METHOD OF DRIVING THE SAME

CROSS REFERENCE TO RELATED APPLICATION

This application is a continuation of U.S. patent application Ser. No. 16/418,937, filed on May 21, 2019, which claims priority from and the benefit of Korean Patent Application No. 10-2018-0078011, filed on Jul. 5, 2018, which is hereby incorporated by reference for all purposes as if fully set forth herein.

BACKGROUND

Field

Implementations of the invention relate generally to a display device and a method of driving the display device, and more specifically, to a display device for improving a display quality and a method of driving the display device.

Discussion of the Background

The organic light emitting display device is a device for displaying images using organic light emitting diodes. Driving transistors that supply current to the organic light emitting diodes and the organic light emitting diodes can be degraded by use. The organic light emitting display device cannot display images of desired luminance due to deterioration of the organic light emitting diodes or driving transistors.

The organic light emitting display device applies a reference signal to the pixels, measures the current flowing into each of the pixels according to the reference signal, determines the deterioration of the pixel based on the measured current and compensates for the deterioration of the pixels.

The deterioration compensation methods include an inside compensation method for placing compensation circuits inside the pixels and an external compensation method for placing compensation circuits outside the panel to simplify the circuit structure within the pixels.

The above information disclosed in this Background section is only for understanding of the background of the inventive concepts, and, therefore, it may contain information that does not constitute prior art.

SUMMARY

Devices constructed according to implementations of the invention are capable of providing a display device for improving a display quality. Also, methods according to implementations of the invention are capable of driving the display device.

Additional features of the inventive concepts will be set forth in the description which follows, and in part will be apparent from the description, or may be learned by practice of the inventive concepts.

According to one or more embodiments of the invention, a display device includes a display part including an organic light emitting diode connected to a pixel circuit including a driving transistor connected to the organic light emitting diode, a switching transistor connected to a scan line and a sensing transistor connected to a sensing scan line, a signal generator configured to generate at least one display output enable (OE) signal during an image display period in which the organic light emitting diode is configured to emit a light;

and generate at least one sensing OE signal during a sensing period in which a sensing signal is received from the pixel circuit; and a scan driver including a display scan signal terminal as an odd numbered output terminal connected to the scan line and a sensing scan signal terminal as an even numbered output terminal connected to the sensing scan line, wherein the scan driver is configured to: generate a scan signal for turning on the switching transistor in response to the display OE signal during the image display period; and generate a sensing scan signal for turning on the sensing transistor in response to the sensing OE signal during the sensing period.

During the image display period, the scan driver may be configured to sequentially output a plurality of scan signals having an ON voltage for turning on the switching transistor to a plurality of scan lines; and sequentially output a plurality of sensing scan signals having an ON voltage for turning on the sensing transistor to a plurality of sensing scan lines.

During the sensing period, the scan driver may be configured to: output a plurality of scan signals having an OFF voltage for turning off the switching transistor to a plurality of scan lines; and sequentially output a plurality of sensing scan signals having the ON voltage to a plurality of sensing scan lines.

During the sensing period, the scan driver may be configured to: output a plurality of scan signals having an OFF voltage for turning off the switching transistor to a plurality of scan lines; and sequentially output a plurality of sensing scan signals having the ON voltage to a sensing scan line corresponding to an sensing area which is preset in the display part.

The scan driver may be configured to generate a sensing scan signal of the sensing area based on a logical operation result of the plurality of sensing OE signals.

The sensing area may be preset to include at least one pixel row, and the sensing signal may be received from the pixel circuit in the at least one pixel row.

A location of the sensing area in the display part may be changed by at least one frame.

The switching transistor may include a gate electrode connected to a scan line, a first electrode connected to a data line and a second electrode connected to a gate electrode of the driving transistor, the sensing transistor may include a gate electrode connected to a sensing scan line, a first electrode connected to a second electrode of the driving transistor and a second electrode connected to a sensing line, and the organic light emitting diode may include an anode electrode connected to a second electrode of the driving transistor.

During the image display period, the switching transistor may be turned on in response to the ON voltage of the scan signal and a data voltage applied to the data line may be applied to a gate electrode of the driving transistor, and during the image display period, the sensing transistor may be turned on in response to the ON voltage of the sensing scan signal and an initial voltage applied to the sensing line is applied to the anode electrode of the organic light emitting diode.

During the sensing period, the switching transistor may be turned off in response to the OFF voltage of the scan signal, and during the image display period, the sensing transistor may be turned on in response to the ON voltage of the sensing scan signal and the sensing signal of the pixel circuit may be applied to the sensing line.

According to one or more embodiments of the invention, a method of driving a display device which includes a display part including an organic light emitting diode connected to a pixel circuit including a driving transistor connected to the organic light emitting diode, a switching transistor connected to a scan line and a sensing transistor connected to a sensing scan line, the method includes generating at least one display output enable (OE) signal during an image display period in which the organic light emitting diode emits a light, providing a scan signal having an ON voltage turning on the switching transistor in response to the display OE signal to a scan line during the image display period, generating at least one sensing OE signal during a sensing period in which a sensing signal is received from the pixel circuit, and providing a sensing scan signal having an ON voltage turning on the sensing transistor in response to the sensing OE signal to a sensing scan line during the sensing period.

The method may further include: during the image display period, sequentially outputting a plurality of scan signals having an ON voltage for turning on the switching transistor to a plurality of scan lines; and during the image display period, sequentially outputting a plurality of sensing scan signals having an ON voltage for turning on the sensing transistor to a plurality of sensing scan lines.

The method may further include: during the sensing period, outputting a plurality of scan signals having an OFF voltage for turning off the switching transistor to a plurality of scan lines; and during the sensing period, sequentially outputting a plurality of sensing scan signals having the ON voltage to a plurality of sensing scan lines.

The method may further include: during the sensing period, outputting a plurality of scan signals having an OFF voltage for turning off the switching transistor to a plurality of scan lines; and during the sensing period, sequentially outputting a plurality of sensing scan signals having the ON voltage to a sensing scan line corresponding to an sensing area which is preset in the display part.

The method may further include logic operating a plurality of sensing OE signals; and generating a sensing scan signal of the sensing area in response to a result of the logic operation of the plurality of sensing OE signals.

The sensing area may be preset to include at least one pixel row, and the sensing signal may be received from the pixel circuit in the at least one pixel row.

A location of the sensing area in the display part may be changed by at least one frame.

The switching transistor may include a gate electrode connected to a scan line, a first electrode connected to a data line and a second electrode connected to a gate electrode of the driving transistor, the sensing transistor may include a gate electrode connected to a sensing scan line, a first electrode connected to a second electrode of the driving transistor and a second electrode connected to a sensing line, and the organic light emitting diode may include an anode electrode connected to a second electrode of the driving transistor.

The method may further include: during the image display period, turning on the switching transistor in response to the ON voltage of the scan signal and a data voltage applied to the data line is applied to a gate electrode of the driving transistor; and during the image display period, turning on the sensing transistor in response to the ON voltage of the sensing scan signal and an initial voltage applied to the sensing line is applied to the anode electrode of the organic light emitting diode.

The method may further include: during the sensing period, turning off the switching transistor in response to the OFF voltage of the scan signal; and during the sensing period, turning on the sensing transistor in response to the ON voltage of the sensing scan signal and the sensing signal of the pixel circuit may be applied to the sensing line.

According to one or more embodiments of the invention, a method of driving a display device having a plurality of pixel circuits each including a driving transistor, a storage capacitor electrically connected to the driving transistor, an organic light emitting diode electrically connected to the driving transistor, a switching transistor electrically connected to the driving transistor and a data line, with a gate electrode of the switching transistor being connected to a scan line, and a sensing transistor electrically connected to the organic light emitting diode and a sensing line, with a gate electrode of the sensing transistor being connected to a sensing scan line, includes: generating a display output enable (OE) signal having a plurality of first pulses during an image display period in which the pixel circuits perform a light emitting operation; providing scan signals for turning on the switching transistors for a data voltage applied to the data line to be stored in the storage capacitor in response to the first pulses of the display OE signal during the image display period; providing sensing scan signals for turning on the sensing transistors for an initial voltage applied to the sensing line to be applied to the organic light emitting diode in response to the first pulses of the display OE signal during the image display period; generating a sensing OE signal having a plurality of second pulses during a sensing period in which at least some of the pixel circuits perform a sensing operation, the number of second pulses being less than the number of first pulses; providing scan signals for turning off the switching transistors in response to the second pulses of the sensing OE signal during the sensing period; and providing at least some of the sensing scan signals for turning on at least some of the sensing transistors for a sensing signal at an anode of the organic light emitting diode to be applied to the sensing line in response to the second pulses of the sensing OE signal during the sensing period.

The scan signals for turning on the switching transistors may be sequentially output to all of the scan lines for the light emitting operation during the image display period.

The scan signals for turning off the switching transistors may be output to all of the scan lines for the sensing operation during the sensing period.

The sensing scan signals for turning on the sensing transistors may be sequentially output to all of the sensing scan lines for the light emitting operation during the image display period.

The at least some of the sensing scan signals for turning on the at least some of the sensing transistors may be sequentially output to corresponding ones of the sensing scan lines for the sensing operation during the sensing period.

A sensing area of the display device may be preset to include at least one pixel row, and the sensing signal may be received from the pixel circuit in the at least one pixel row.

A location of the sensing area of the display device may be changed by at least one frame.

The switching transistor may include the gate electrode connected to the scan line, a first electrode connected to the data line, and a second electrode connected to a gate electrode of the driving transistor.

The sensing transistor may include the gate electrode connected to the sensing scan line, a first electrode connected to a second electrode of the driving transistor and the anode of the organic light emitting diode, and a second electrode connected to the sensing line.

The data voltage applied to the data line may be applied to the gate electrode of the driving transistor during the image display period, and the initial voltage applied to the sensing line may be applied to the anode of the organic light emitting diode during the image display period.

According to the inventive concepts, the sensing OE signal for activating the only sensing scan lines of the sensing area in the display part is generated and thus, the sensing signal is received from the only pixel circuits of the sensing area based on the sensing OE signal. Therefore, a decoder for activating the sensing scan lines of the sensing area is omitted and thus, the scan driver is simplified.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the inventive concepts.

DETAILED DESCRIPTION

Figure 1:
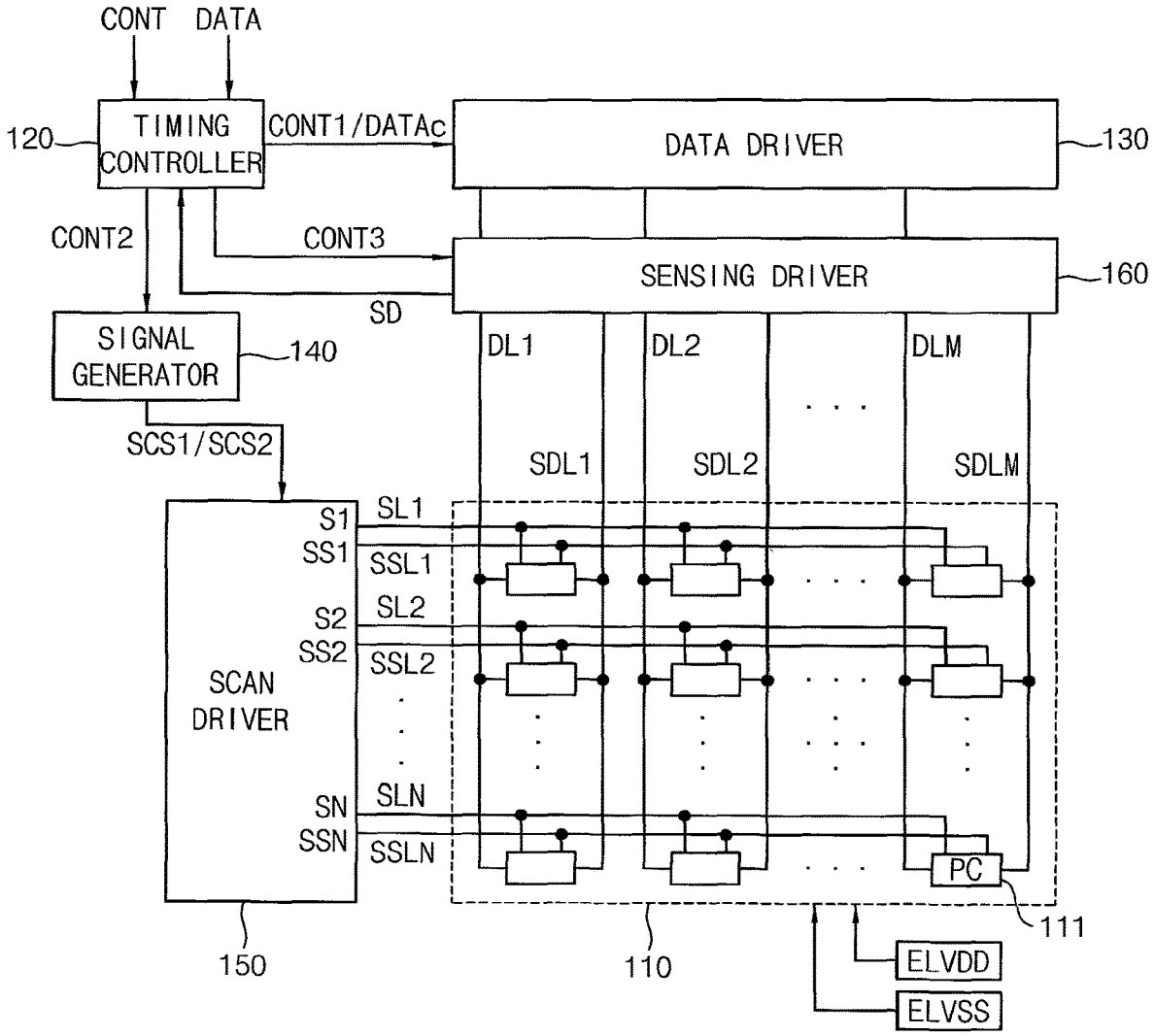
FIG. 1 is a block diagram illustrating an organic light emitting display device according to an embodiment.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
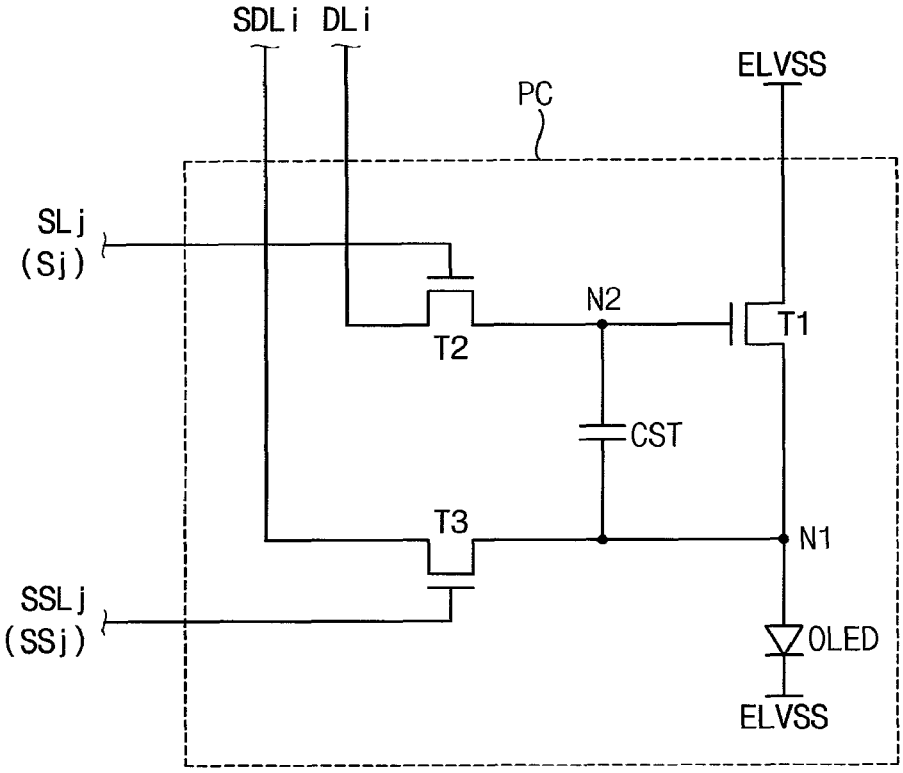
FIG. 2 is a circuit diagram illustrating a pixel circuit according to an embodiment.
Figure 3:
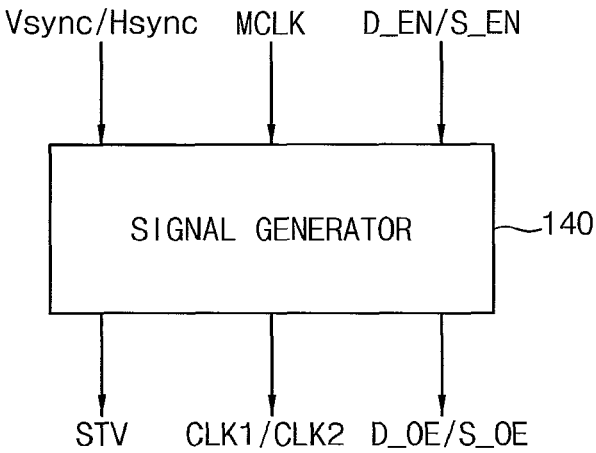
FIG. 3 is a block diagram illustrating a signal generator of FIG. 1.

FIG. 1 is a block diagram illustrating an organic light emitting display device according to an embodiment. FIG. 2 is a circuit diagram illustrating a pixel circuit according to an embodiment. FIG. 3 is a block diagram illustrating a signal generator of FIG. 1.

Referring to FIG. 1, the organic light emitting display device may include a display part 110, a timing controller 120, a data driver 130, a signal generator 140, a scan driver 150, and a sensing driver 160.

The display part 110 may include a plurality of pixels 111, a plurality of scan lines SL1, SL2, . . . , SLN, a plurality of sensing scan line SSL1, SSL2, . . . , SSLN, a plurality of data lines DL1, DL2, . . . , DM, and a plurality of sensing line SDL1, SDL2, . . . , SDLM (wherein, 'N' and 'M' are natural numbers).

The pixels 111 may be arranged in a matrix type that includes the plurality of pixel rows and the plurality of pixel columns. The pixel row may correspond to a horizontal line for the display part 110, and the pixel column may correspond to a vertical line for the display part 110.

Each pixel 111 may include a pixel circuit PC, and the pixel circuit PC may include a plurality of transistors which is connected to a scan line, a sensing scan line, a data line, and a sensing line, and an organic light emitting diode which is connected to the plurality of transistors.

For example, referring to FIG. 2, the pixel circuit PC of the pixel includes an i-th data line DLi, an i-th sensing line SDLi, a j-th scan line SLj, a j-th sensing scan line SSLj, a driving transistor T1, an organic light emitting diode OLED, a switching transistor T2, a storage capacitor CST and a sensing transistor T3 (wherein, 'i' is a natural number which is equal to or smaller than 'N' and 'j' is a natural number which is equal to or larger than 'M').

The i-th data line DLi is connected to an output terminal of the data driver 130 and transmits a data voltage.

The i-th sensing line SDLi is connected to the sensing driver 160. The i-th sensing line SDLi transmits an initial voltage for initializing the pixel circuit PC in an image display period and transmits a sensing signal generated in the pixel circuit PC to the sensing driver 160 in a sensing period.

The j-th scan line SLj may be connected to a j-th display scan signal terminal of the scan driver 150 which is a j-th odd numbered output terminal of the scan driver 150 and transmits an j-th scan signal Sj generated from the scan driver 150.

The j-th sensing scan line SSLj may be connected to a j-th sensing scan signal terminal of the scan driver 150 which is a j-th even numbered output terminal of the scan driver 150, and transmits a j-th sensing scan signal SSj generated from the scan driver 150.

The driving transistor T1 includes a gate electrode connected to a storage capacitor CST, a first electrode receiving a first power source voltage ELVDD and a second electrode connected to an anode electrode of the organic light emitting diode OLED.

The organic light emitting diode OLED includes the anode electrode connected to a second electrode of the driving transistor T1 and a cathode electrode receiving a second power source voltage ELVSS.

The switching transistor T2 includes a gate electrode connected to an j-th scan line SLj, a first electrode connected to the i-th data line DLi and a second electrode connected to a gate electrode of the driving transistor T1.

The storage capacitor CST includes a first electrode connected to a gate electrode of the driving transistor T1 and a second electrode connected to the anode electrode of the organic light emitting diode OLED.

The sensing transistor T3 includes a gate electrode connected to the j-th sensing scan line SSLj, a first electrode connected to a second electrode of the driving transistor T1 and a second electrode connected to the i-th sensing line SDLi.

The organic light emitting display device is powered on, i.e. the pixel circuit PC is operated in the image display period as follows.

During a first period of the image display period, in which the switching transistor T2 receives an ON voltage of the j-th scan signal Sj through the j-th scan line SLj, the switching transistor T2 is turned on in response to the ON voltage of the j-th scan signal Sj, and a data voltage applied to the i-th data line DLi is applied to a second node N2 which is the gate electrode of the driving transistor T1 and is stored at the storage capacitor CST.

The driving transistor T1 is turned on based on the data voltage, and a driving current by the first power source voltage ELVDD flows toward the anode electrode of the organic light emitting diode OLED, which is a first node N1.

The organic light emitting diode OLED emits a light of an image in response to the driving current generated corresponding to the data voltage.

During a second period of the image display period, in which the sensing transistor T3 receives the ON voltage of the j-th sensing scan signal SSj, the sensing transistor T3 is turned on in response to the ON voltage of the j-th sensing scan signal SSj, and the initial voltage applied to the i-th sensing line SDLi is applied to the anode electrode (N1) of the organic light emitting diode OLED. Thus, the anode electrode (N1) of the organic light emitting diode OLED may be initialized.

The organic light emitting display device is powered off, i.e. the pixel circuit PC is operated in the sensing period as follows.

During the sensing period, the switching transistor T2 is turned off in response to an OFF voltage of the j-th scan signal Sj, and the sensing transistor T3 is turned on in response to the ON voltage of the j-th sensing scan signal SSj.

Thus, a sensing signal of the first node N1 which is connected to the second electrode of the driving transistor T1 and the anode electrode of the organic light emitting diode OLED is transmitted to the sensing driver 160 through the i-th sensing line SDLi.

The timing controller 120 may receive a control signal CONT and image data DATA from an external graphics device. The timing controller 120 is configured to generate a plurality of control signals based on the control signal CONT. The plurality of control signals may include a first control signal CONT1 for controlling the data driver 130, a second control signal CONT2 for controlling the signal generator 140 and a third control signal CONT3 for controlling the sensing driver 160.

The data driver 130 is configured to analog to digital convert corrected image data DATAc received from the timing controller 120 to generate a data voltage based on the first control signal CONT1 provided from the timing controller 120 and to transmit the data voltage to the data line.

The signal generator 140 is configured to generate a scan control signal for controlling the scan driver 150 based on the second control signal CONT2.

The scan control signal may include a first scan control signal SCS1 in the image display period in which the pixel circuit PC display an image, and a second scan control signal SCS2 in the sensing period in which the sensing signal is received from the pixel circuit PC.

For example, Referring to FIG. 3, the signal generator 140 is configured to receive a vertical sync signal Vsync, a horizontal sync signal Hsync, a main clock signal MCLK and an image enable signal D_EN (or a sensing enable signal S_EN) which is a second control signal CONT2 provided from the timing controller 120.

The image enable signal D_EN may be activated on the image display period and deactivated on the sensing period. The sensing enable signal S_EN can be activated on the sensing period and deactivated on the image display period.

During the image display period, the signal generator 140 is configured to generate a start vertical signal STV and a plurality of clock signals CLK1 and CLK2. In addition, the signal generator 140 is configured to generate at least one display output enable signal (hereinafter, display OE signal D_OE). The at least one display OE signal D_OE controls a falling timing of a scan signal outputted from an odd numbered output terminal as a display scan signal terminal and an even numbered output terminal as a sensing scan signal terminal of the scan driver 150.

During the sensing period, the signal generator 140 is configured to generate a start vertical signal STV and a plurality of clock signals CLK1 and CLK2. In addition, the signal generator 140 is configured to generate the at least one sensing output enable (OE) signal (sensing OE signal, S_OE). The sensing OE signal controls the scan driver 150 to mask a scan signal outputted from the display scan signal terminal of the scan driver 150 and to output a sensing scan signal from the sensing scan signal terminal of the scan driver 150 corresponding to the sensing area in the display part.

The scan driver 150 is configured to generate a plurality of scan signals S1, S2, . . . , SN and a plurality of sensing scan signals SS1, SS2, . . . , SSN in response to the first scan control signal SCS1 in the image display period. The scan driver includes a plurality of output terminals, odd numbered output terminals as display scan signal terminals connected to the plurality of scan lines SL1 to SLN, and even numbered output terminals as sensing scan signal terminals connected to the plurality of sensing scan line SSL1 to SSLN.

The sensing driver 160 is connected to the plurality of sensing lines SDL1, SDL2, . . . , SDLM. The sensing driver 160 is configured to provide the plurality of sensing lines SDL1, SDL2, . . . , SDLM with an initial voltage based on the third control signal in the image display period, and to receive a sensing signal from the plurality of pixels in the sensing area in the sensing period.

The sensing driver 160 is configured to generate sensing data SD using the sensing signal received from the pixels in the sensing area and to provide the timing controller 120 with the sensing data SD. The timing controller 120 is configured to calculate compensation data for compensating the image data using the sensing data SD, to apply the compensation data to the image data and to generate correction image data DATAc. The correction image data DATAc may be provided to the data driver 130.

In embodiments, the timing controller 120, the data driver 130, the signal generator 140, the scan driver 150, the sensing driver 160, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to one or more embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the timing controller 120, the data driver 130, the signal generator 140, the scan driver 150, the sensing driver 160, and/or one or more components thereof may include or otherwise be associated with one or more memories (not shown) including code (e.g., instructions) configured to cause the timing controller 120, the data driver 130, the signal generator 140, the scan driver 150, the sensing driver 160, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CD-RW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 4:
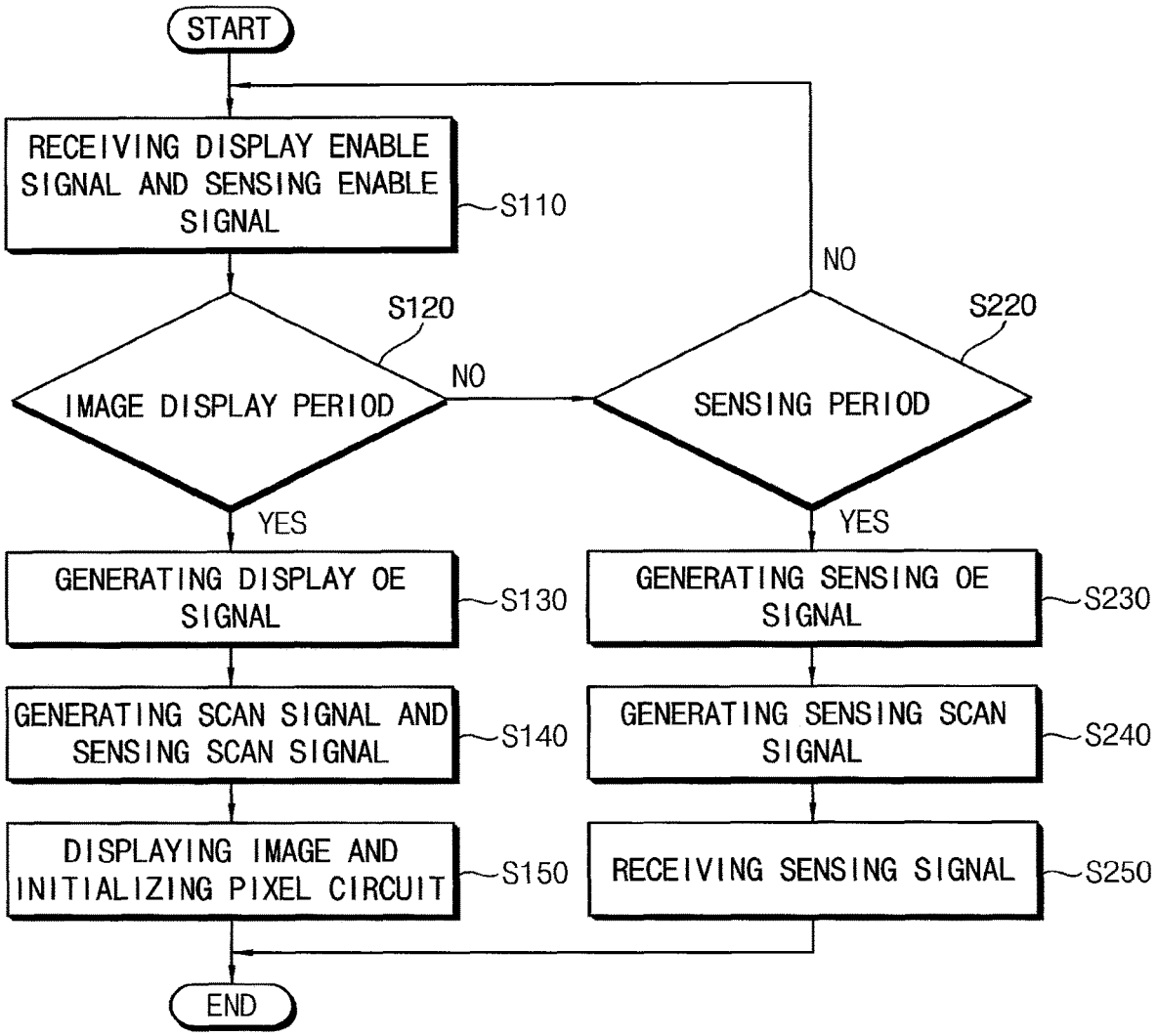
FIG. 4 is a flowchart diagram illustrating a method of driving the organic light emitting display device according to an embodiment.
Figure 5:
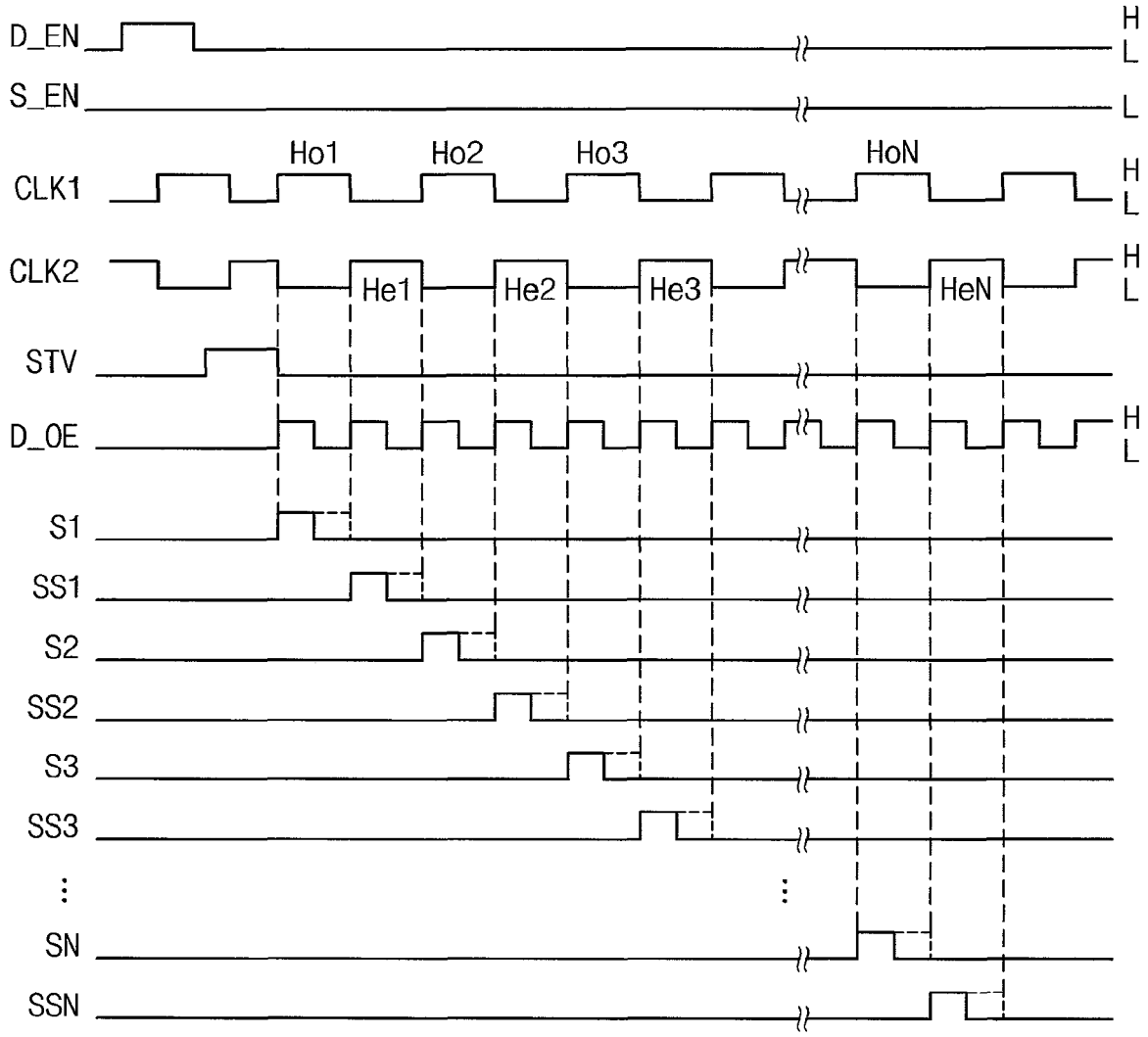
FIG. 5 is a waveform diagram illustrating a method of driving a scan driver during an image display period according to an embodiment.

FIG. 4 is a flowchart diagram illustrating a method of driving the organic light emitting display device according to an embodiment. FIG. 5 is a waveform diagram illustrating a method of driving a scan driver during an image display period according to an embodiment.

Referring to FIGS. 1, 4, and 5, a method of driving the organic light emitting display device during the image display period is explained.

The signal generator 140 receives a display enable signal D_EN and a sensing enable signal S_EN from the timing controller 120 (S110).

For example, in the image display period, the display enable signal D_EN is activated and the sensing enable signal S_EN is deactivated. When the signal generator 140 receives the display enable signal D_EN which is activated (S120), the signal generator 140 generates a start vertical signal STV, a plurality of clock signals CLK1 and CLK2 and a single display OE signal D_OE (S130).

The scan driver 150 receives the start vertical signal STV, the plurality of clock signals CLK1 and CLK2 and the single display OE signal D_OE.

The scan driver 150 starts an operation based on the start vertical signal STV.

The scan driver 150 may generate the scan signal and the sensing scan signal based on the plurality of clock signals CLK1 and CLK2.

The scan driver 150 generates a plurality of scan signals S1, S2, S3, . . . , SN in synchronization with a first clock signal CLK1. The plurality of scan signals S1, S2, S3, . . . , SN may have a high voltage period corresponding to a high voltage period of the first clock signal CLK1. The high voltage period is the period with a high voltage H, and the low voltage period is the period with a low voltage L.

The scan driver 150 generates plurality of sensing scan signals SS1, SS2, SS3, . . . , SSN in synchronization with a second clock signal CLK2. The plurality of sensing scan signals SS1, SS2, SS3, . . . , SSN may have a high voltage period corresponding to a high voltage period of the second clock signal CLK2. The second clock signal CLK2 may have a delay difference from the first clock signal CLK1.

A frame period may include first to N-th odd numbered horizontal periods Ho1 to HoN corresponding to the first to N-th scan signals S1 to SN and first to N-th even numbered horizontal periods He1 to HeN corresponding to first to N-th sensing scan signals SS1 to SSN.

The display OE signal D_OE have a high voltage H and a low voltage L in a horizontal period, and may be an alternating current (AC) signal swinging between the high voltage H and the low voltage L by a horizontal period. Thus, the horizontal period of the display OE signal D_OE may have a high voltage period having the high voltage H and a low voltage period having the low voltage L.

The scan driver 150 may control an output of the plurality of scan signals S1, S2, S3, . . . , SN based on the display OE signal D_OE.

For example, the scan driver 150 may control the plurality of scan signals S1, S2, S3, . . . , SN into the high voltage H in a period overlapping with the high voltage period of the display OE signal D_OE and the plurality of scan signals S1, S2, S3, . . . , SN into the low voltage L in a period overlapping with the low voltage period of the display OE signal D_OE. The high voltage H of the scan signal is the ON voltage for turning on the switching transistor in the pixel circuit and the low voltage L of the scan signal is the OFF voltage for turning off the switching transistor in the pixel circuit.

In addition, the scan driver 150 may control an output of the plurality of sensing scan signals SS1, SS2, SS3, . . . , SSN based on the display OE signal D_OE.

For example, the scan driver 150 may control the plurality of sensing scan signals SS1, SS2, SS3, . . . , SSN into the high voltage H in a period overlapping with the high voltage period of the display OE signal D_OE and the plurality of sensing scan signals SS1, SS2, SS3, . . . , SSN into the low voltage L in a period overlapping with the low voltage period of the display OE signal D_OE. The high voltage H of the scan signal is the ON voltage for turning on the sensing transistor in the pixel circuit and the low voltage L of the scan signal is the OFF voltage for turning off the sensing transistor in the pixel circuit.

Therefore, the high voltage period of the plurality of scan signals S1, S2, S3, . . . , SN and the plurality of sensing scan signals SS1, SS2, SS3, . . . , SSN may decrease by the low voltage period of the display OE signal D_OE.

The scan driver 150 generates the plurality of scan signals S1, S2, S3, . . . , SN, and sequentially outputs through the odd numbered output terminals of the scan driver 150, which are the display scan signal terminals, to the first to N-th scan lines SL1 to SLN. The scan driver 150 generates the plurality of sensing scan signals SS1, SS2, SS3, . . . , SSN and sequentially outputs through the even numbered output terminals of the scan driver 150, which are the sensing scan signal terminals, to the first to N-th sensing scan lines SSL1 to SSLN (Step S140). However, the data driver 130 outputs a plurality of data voltages to the plurality of data lines DL1, DL2, . . . , DM. The sensing driver 160 may output the plurality of initial voltages to the plurality of sensing line SDL1, SDL2, . . . , SDLM.

The pixel circuit of the display part 110 may emit the light corresponding to the data voltage in response to the scan signal. The pixel circuit of the display part 110 may initialize based on the initial voltage in response to the sensing scan signal (Step S150).

Figure 6:
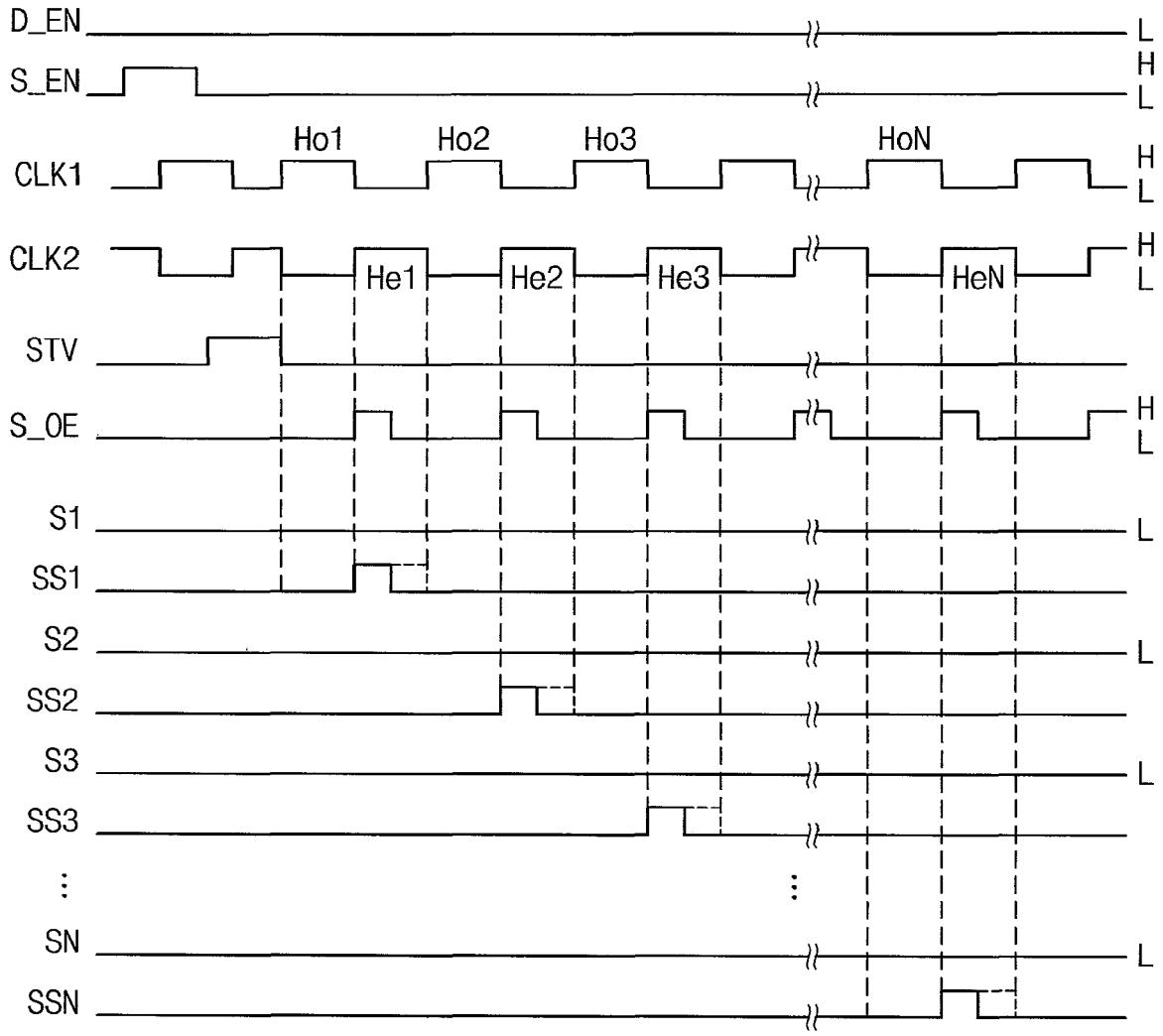
FIG. 6 is a waveform diagram illustrating a method of driving a scan driver during a sensing period according to an embodiment.

FIG. 6 is a waveform diagram illustrating a method of driving a scan driver during a sensing period according to an embodiment.

Referring to FIGS. 1, 4, and 6, the organic light emitting display device may receive the sensing signals from all pixels of the display part 110 in the sensing period.

In the sensing period, a method of driving the organic light emitting display device is explained.

The signal generator 140 receives a display enable signal D_EN and a sensing enable signal S_EN (Step S110).

For example, in the sensing period, the sensing enable signal S_EN is activated and the display enable signal D_EN is deactivated. When the signal generator 140 receives the sensing enable signal S_EN which is activated (Step S220), the signal generator 140 generates a start vertical signal STV, a plurality of clock signals CLK1 and CLK2 and a single sensing OE signal S_OE (Step S230).

The scan driver 150 receives the start vertical signal STV, the plurality of clock signals CLK1 and CLK2 and the single sensing OE signal S_OE.

The scan driver 150 starts an operation based on the start vertical signal STV.

The scan driver 150 may generate the scan signal and the sensing scan signal based on the plurality of clock signals CLK1 and CLK2.

The scan driver 150 generates a plurality of scan signals S1, S2, S3, . . . , SN in synchronization with a first clock signal CLK1. The plurality of scan signals S1, S2, S3, . . . , SN may have a high voltage period corresponding to a high voltage period of the first clock signal CLK1. The high voltage period is the period with a high voltage H, and the low voltage period is the period with a low voltage L.

The scan driver 150 generates plurality of sensing scan signals SS1, SS2, SS3, . . . , SSN in synchronization with a second clock signal CLK2. The plurality of sensing scan signals SS1, SS2, SS3, . . . , SSN may have a high voltage period corresponding to a high voltage period of the second clock signal CLK2. The second clock signal CLK2 may have a delay difference from the first clock signal CLK1.

A frame period may include first to N-th odd numbered horizontal periods Ho1 to HoN corresponding to the first to N-th scan signals S1 to SN and first to N-th even numbered horizontal periods He1 to HeN corresponding to first to N-th sensing scan signals SS1 to SSN.

In an embodiment, a sensing area corresponds to an entire area of the display part. The sensing OE signal S_OE may have first to N-th even numbered horizontal periods He1 to HeN corresponding to first to N-th sensing scan signals SS1 to SSN, and each of the first to N-th even numbered horizontal periods He1 to HeN may have a high voltage period having a high voltage H and a low voltage period having a low voltage L. the sensing OE signal S_OE may have first to N-th odd numbered horizontal periods Ho1 to HoN corresponding to first to N-th scan signals S1 to SN and each of the first to N-th odd numbered horizontal periods Ho1 to HoN may have the low voltage L.

The scan driver 150 may control the first to N-th sensing scan signals SS1 to SSN into the high voltage H in a period overlapping with the high voltage period of the sensing OE signal S_OE, and into the low voltage L in a period overlapping with the low voltage period of the sensing OE signal S_OE.

Thus, the scan driver 150 generates the first to N-th sensing scan signals SS1 to SSN having the high voltage H corresponding to the sensing area, and sequentially outputs the first to N-th sensing scan signals SS1 to SSN through the even numbered output terminals of the scan driver 150 to the first to N-th sensing scan lines SSL1 to SSLN (Step S240).

The scan driver 150 controls the first to N-th scan signals S1 to SN into the low voltage L based on the sensing OE signal S_OE.

Thus, the scan driver 150 outputs the first to N-th scan signals S1 to SN having the low voltage L through the odd numbered output terminals of the scan driver 150 to the first to N-th scan lines SL1 to SLN.

The sensing driver 160 receives sensing signals from all pixel circuits in the display part 110 that is the sensing area in response to the first to N-th sensing scan signals SS1 to SSN through the plurality of sensing lines SDL1, SDL2, . . . , SDLM (Step S250).

Therefore, in the sensing period, the sensing OE signal for activating all sensing scan lines of the display part is generated and thus, the sensing signal is received from all pixel circuits of the display part based on the sensing OE signal.

Figure 7A:
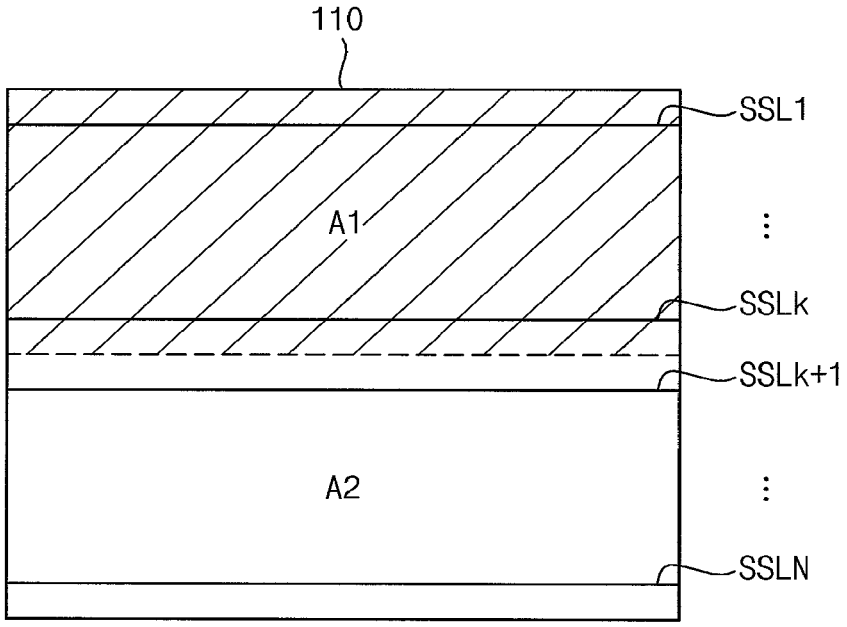
FIG. 7A is a concept drawing of the organic light emitting display device illustrating the method of driving a scan driver during a sensing period according to an embodiment.
Figure 7B:
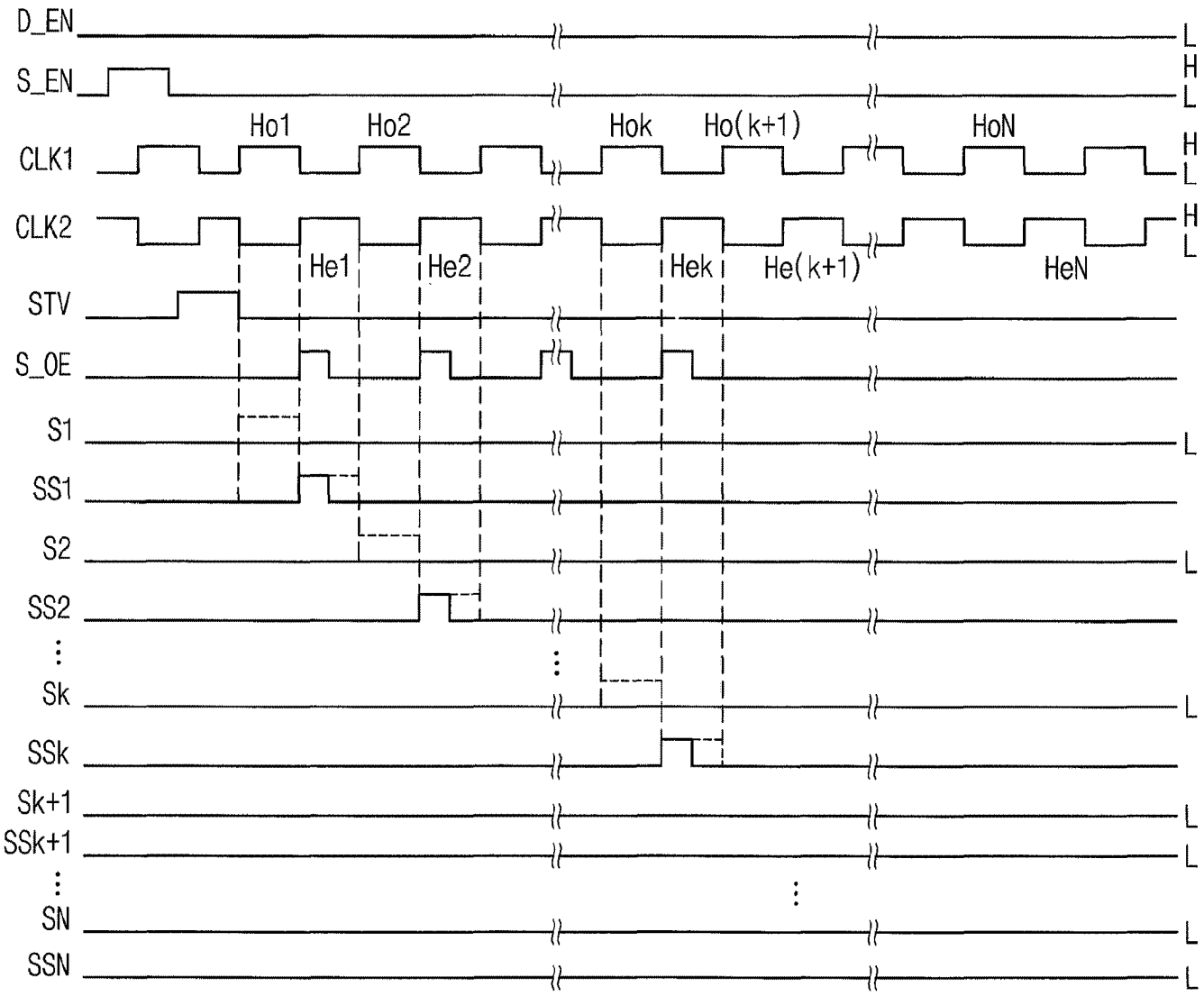
FIG. 7B is a waveform diagram illustrating a method of driving a scan driver during a sensing period according to an embodiment.

FIG. 7A is a concept drawing of the organic light emitting display device illustrating the method of driving a scan driver during a sensing period according to an embodiment. FIG. 7B shows waveform diagrams illustrating a method of driving a scan driver during a sensing period according to an embodiment.

Referring to FIG. 7A, the organic light emitting display device may receive a sensing signal from a plurality of pixels in a sensing area which is preset of the display part 110.

For example, the display part 110 includes a first area A1 and a second area A2, and the first area A1 is preset as the sensing area. A location of the sensing area in the display part 110 may be preset variously and be changed by at least one frame. The sensing area may include at least one pixel row.

Referring to FIGS. 1, 4, and 7B, in the sensing period, a method of driving the organic light emitting display device is explained.

The signal generator 140 receives a display enable signal D_EN and a sensing enable signal S_EN from the timing controller 120 (Step S110).

For example, in the sensing period, the sensing enable signal S_EN is activated and the display enable signal D_EN is deactivated. When the signal generator 140 receives the sensing enable signal S_EN which is activated (Step S220), the signal generator 140 generates a start vertical signal STV, a plurality of clock signals CLK1 and CLK2 and a single sensing OE signal S_OE (Step S230).

The scan driver 150 receives the start vertical signal STV, the plurality of clock signals CLK1 and CLK2 and the single sensing OE signal S_OE.

The scan driver 150 starts an operation based on the start vertical signal STV.

The scan driver 150 may generate the scan signal and the sensing scan signal based on the plurality of clock signals CLK1 and CLK2.

The scan driver 150 generates a plurality of scan signals S1, S2, S3, . . . , SN in synchronization with a first clock signal CLK1. The plurality of scan signals S1, S2, S3, . . . , SN may have a high voltage period corresponding to a high voltage period of the first clock signal CLK1. The high voltage period is the period with a high voltage H, and the low voltage period is the period with a low voltage L.

The scan driver 150 generates plurality of sensing scan signals SS1, SS2, SS3, . . . , SSN in synchronization with a second clock signal CLK2. The plurality of sensing scan signals SS1, SS2, SS3, . . . , SSN may have a high voltage period corresponding to a high voltage period of the second clock signal CLK2. The second clock signal CLK2 may have a delay difference from the first clock signal CLK1.

A frame period may include first to N-th odd numbered horizontal periods Ho1 to HoN corresponding to the first to N-th scan signals S1 to SN and first to N-th even numbered horizontal periods He1 to HeN corresponding to first to N-th sensing scan signals SS1 to SSN.

In an embodiment, a sensing area corresponds to a first area A1 of the display part. The sensing OE signal S_OE may have first to k-th even numbered horizontal periods He1 to Hek corresponding to first to k-th sensing scan signals SS1 to SSk in the first area A1, and each of the first to k-th even numbered horizontal periods He1 to Hek may have a high voltage period having a high voltage H and a low voltage period having a low voltage L. The sensing OE signal S_OE may have a low voltage L in remaining horizontal periods of the frame period except for the first to k-th even numbered horizontal periods He1 to Hek. The remaining horizontal periods of the frame period include first to N-th odd numbered horizontal periods Ho1 to HoN. The number k is a natural number equal to or smaller than N.

The scan driver 150 may control the first to k-th sensing scan signals SS1 to SSk into the high voltage H in a period overlapping with the high voltage period of the sensing OE signal S_OE, and into the low voltage L in a period overlapping with the low voltage period of the sensing OE signal S_OE.

Thus, the scan driver 150 generates the first to k-th sensing scan signals SS1 to SSk having the high voltage H corresponding to the first area A1 that is the sensing area, and sequentially outputs the first to k-th sensing scan signals SS1 to SSk to the first to k-th sensing scan lines SSL1 to SSLk of the first area A1 (Step S240).

The scan driver 150 controls the first to k-th scan signals S1 to Sk and (k+1)-th to N-th sensing scan signals SSk+1 to SSN corresponding to the second area A2 into the low voltage L based on the sensing OE signal S_OE.

Therefore, the scan driver 150 outputs the first to N-th scan signals S1 to SN having the low voltage L to the first to N-th scan lines SL1 to SLN, and outputs the (k+1)-th to N-th sensing scan signals SSk+1 to SSN having the low voltage L to the (k+1)-th to N-th sensing scan lines SSLk+1 to SSLN in the second area A2 (Step S240).

The sensing driver 160 receives sensing signals from the pixel circuits in the first area A1 that is the sensing area in response to the first to k-th sensing scan signals SS1 to SSk through the plurality of sensing lines SDL1, SDL2, . . . , SDLM (Step S250).

Therefore, in the sensing period, the sensing OE signal for activating the only sensing scan lines of the first area A1 is generated and thus, the sensing signal is received from the only pixel circuits of the first area A1 based on the sensing OE signal.

Figure 8:
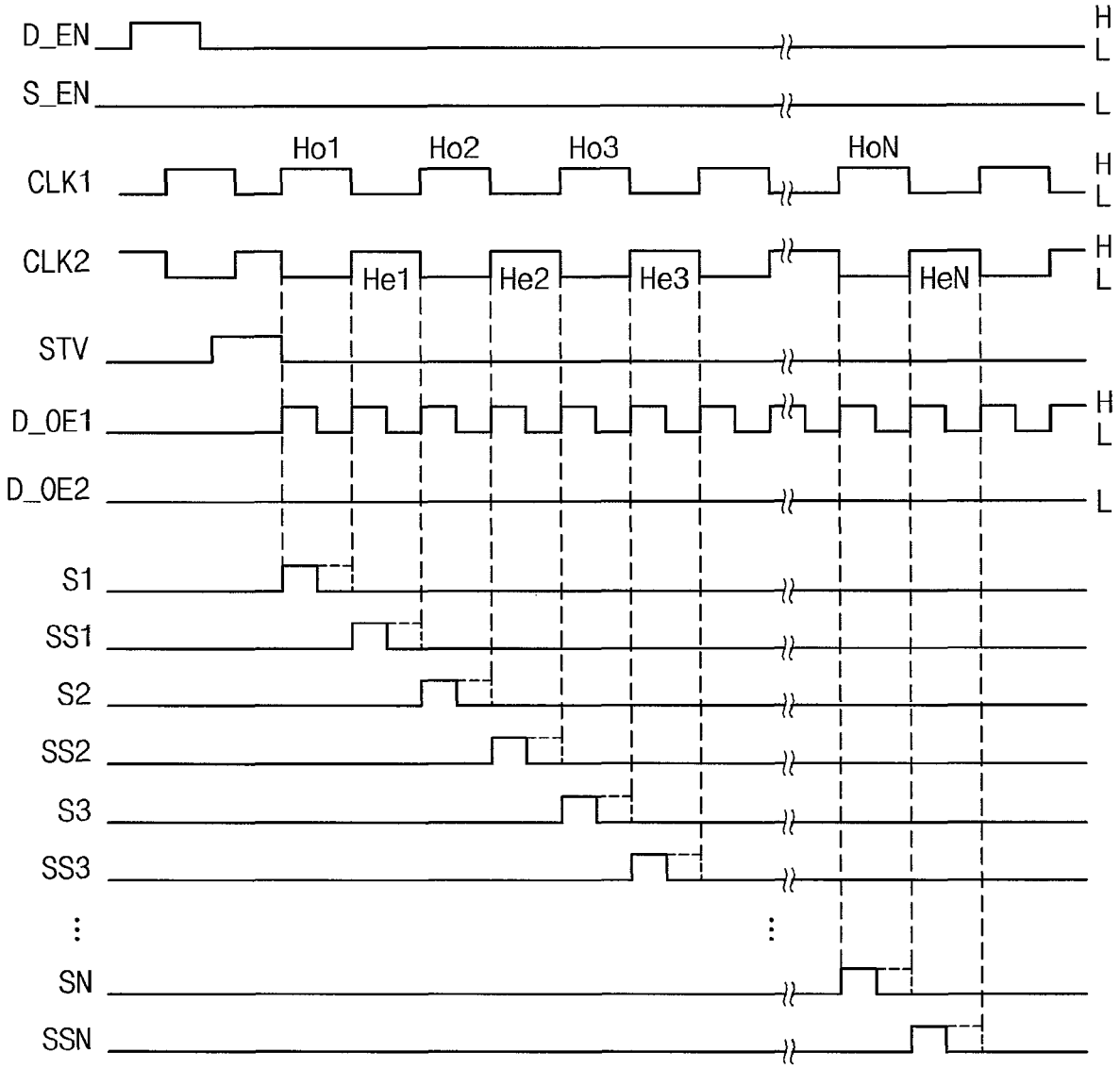
FIG. 8 is a waveform diagram illustrating a method of driving a scan driver during an image display period according to an embodiment.

FIG. 8 is a waveform diagram illustrating a method of driving a scan driver during an image display period according to an embodiment.

Referring to FIGS. 1, 4, and 8, in the image display period, a method of driving the organic light emitting display device is explained.

The signal generator 140 receives a display enable signal D_EN and a sensing enable signal S_EN from the timing controller 120 (Step S110).

For example, in the image display period, the display enable signal D_EN is activated and the sensing enable signal S_EN is deactivated. When the signal generator 140 receives the display enable signal D_EN which is activated (Step S120), the signal generator 140 generates a start vertical signal STV, a plurality of clock signals CLK1 and CLK2 and a plurality of display OE signals D_OE1 and D_OE2 (Step S130).

The scan driver 150 receives the start vertical signal STV, the plurality of clock signals CLK1 and CLK2 and the plurality of display OE signals D_OE1 and D_OE2.

The scan driver 150 starts an operation based on the start vertical signal STV.

The scan driver 150 may generate the scan signal and the sensing scan signal based on the plurality of clock signals CLK1 and CLK2.

The scan driver 150 generates a plurality of scan signals S1, S2, S3, . . . , SN in synchronization with a first clock signal CLK1. The plurality of scan signals S1, S2, S3, . . . , SN may have a high voltage period corresponding to a high voltage period of the first clock signal CLK1. The high voltage period is the period with a high voltage H, and the low voltage period is the period with a low voltage L.

The scan driver 150 generates plurality of sensing scan signals SS1, SS2, SS3, . . . , SSN in synchronization with a second clock signal CLK2. The plurality of sensing scan signals SS1, SS2, SS3, . . . , SSN may have a high voltage period corresponding to a high voltage period of the second clock signal CLK2. The second clock signal CLK2 may have a delay difference from the first clock signal CLK1.

A frame period may include first to N-th odd numbered horizontal periods Ho1 to HoN corresponding to the first to N-th scan signals S1 to SN and first to N-th even numbered horizontal periods He1 to HeN corresponding to first to N-th sensing scan signals SS1 to SSN.

A first display OE signal D_OE1 have a high voltage H and a low voltage L in a horizontal period, and may be an alternating current (AC) signal swinging between the high voltage H and the low voltage L by a horizontal period. Thus, the horizontal period of the first display OE signal D_OE1 may have a high voltage period having the high voltage H and a low voltage period having the low voltage L.

A second display OE signal D_OE2 may be a direct current (DC) signal which always has the low voltage L in the frame period.

The scan driver 150 may control an output of the plurality of scan signals S1, S2, S3, . . . , SN based on a logical operation of the plurality of display OE signals D_OE1 and D_OE2.

For example, the scan driver 150 operates the first and second display OE signals D_OE1 and D_OE2 using an AND logical operator and thus the scan driver 150 may control the plurality of scan signals S1, S2, S3, . . . , SN into the high voltage H in a period overlapping with the high voltage period of the first display OE signal D_OE1 and the plurality of scan signals S1, S2, S3, . . . , SN into the low voltage L in a period overlapping with the low voltage period of the first display OE signal D_OE1.

Therefore, the high voltage period of the plurality of scan signals S1, S2, S3, . . . , SN and the plurality of sensing scan signals SS1, SS2, SS3, . . . , SSN may decrease by the low voltage period of the first display OE signal D_OE1.

As the described above, an output waveform of the scan signal may be controlled using the AND logical operation of two display OE signals D_OE1 and D_OE2, but not limited thereto. The output waveform of the scan signal may be controlled using variously logical operations (OR, AND, XOR, etc.) of two or more display OE signals.

The scan driver 150 generates the plurality of scan signals S1, S2, S3, . . . , SN, and sequentially outputs through the odd numbered output terminals of the scan driver 150 which are the display scan signal terminals of the scan driver 150. The scan driver 150 generates the plurality of sensing scan signals SS1, SS2, SS3, . . . , SSN and sequentially outputs through the even numbered output terminals of the scan driver 150 which are the sensing scan signal terminals of the scan driver 150 (Step S140).

The data driver 130 outputs a plurality of data voltages to the plurality of data lines DL1, DL2, . . . , DM. The sensing driver 160 may output the plurality of initial voltages to the plurality of sensing line SDL1, SDL2, . . . , SDLM.

The pixel circuit of the display part 110 may emit the light corresponding to the data voltage in response to the scan signal. The pixel circuit of the display part 110 may initialize based on the initial voltage in response to the sensing scan signal (Step S150).

Figure 9A:
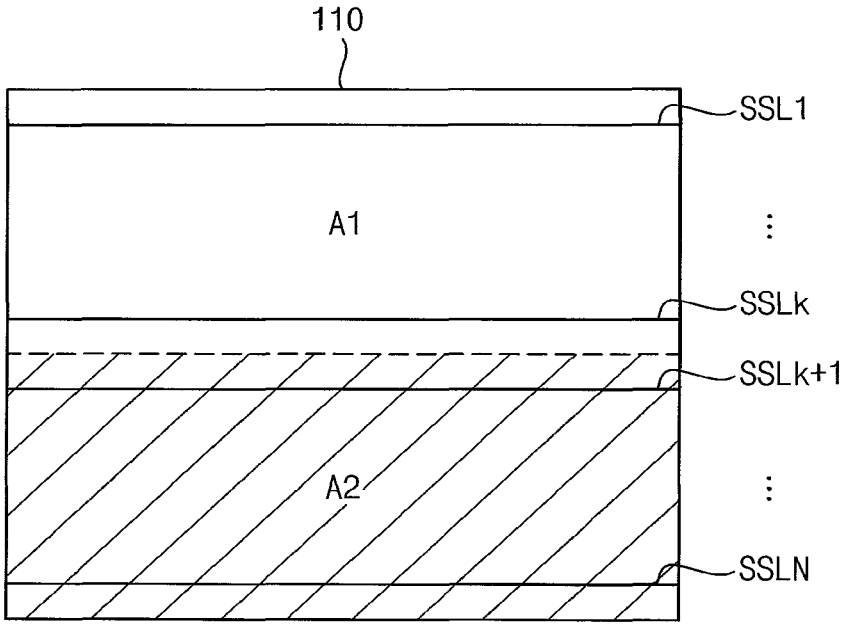
FIG. 9A is a concept drawing of the organic light emitting display device illustrating the method of driving a scan driver during a sensing period according to an embodiment.
Figure 9B:
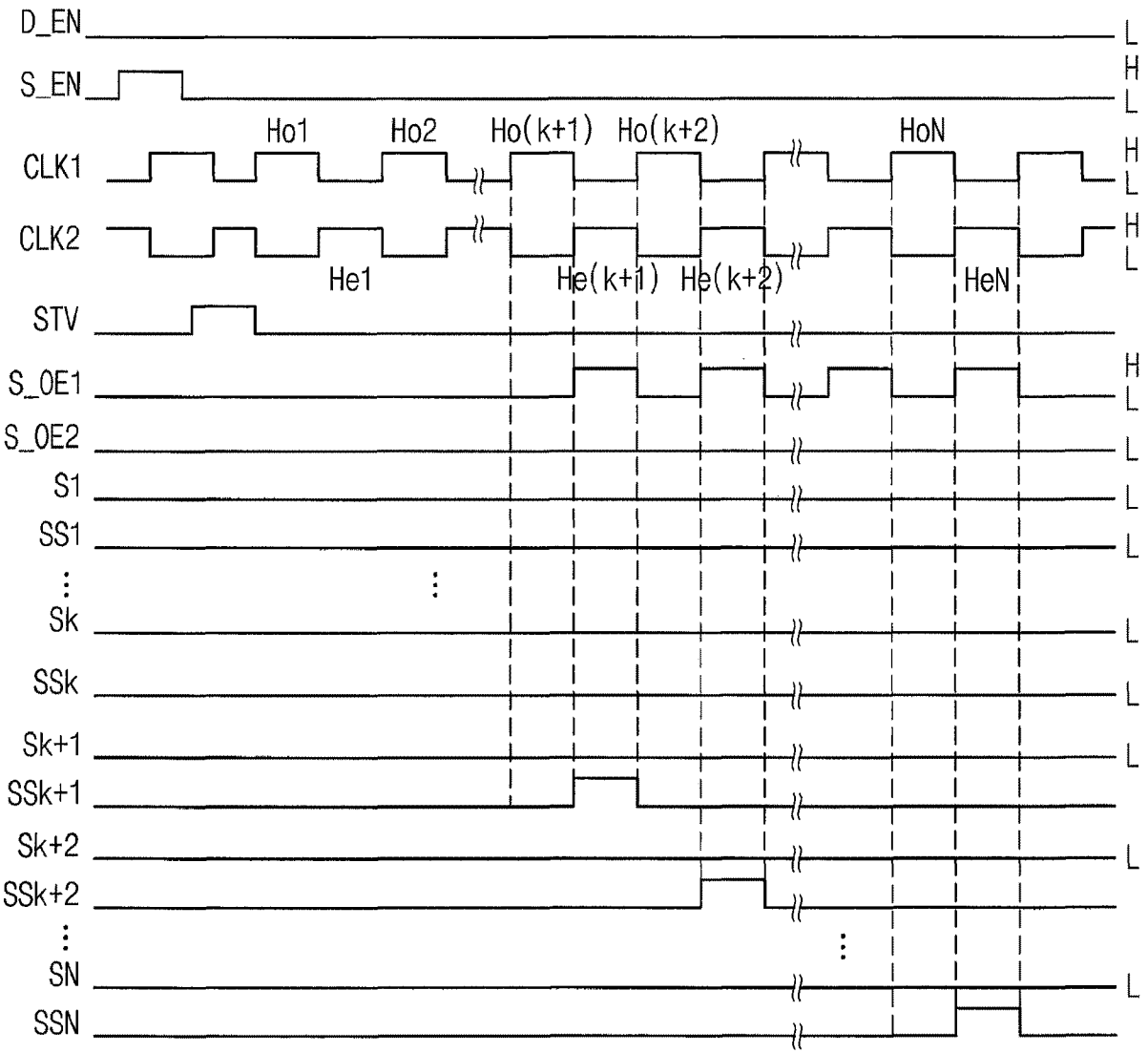
FIG. 9B is a waveform diagram illustrating a method of driving a scan driver during a sensing period according to an embodiment.

FIG. 9A is a concept drawing of the organic light emitting display device illustrating the method of driving a scan driver during a sensing period according to an embodiment. FIG. 9B shows waveform diagrams illustrating a method of driving a scan driver during a sensing period according to an embodiment.

Referring to FIG. 9A, the organic light emitting display device may receive a sensing signal from a plurality of pixel circuits arranged in a partial area of the display part 110 in a sensing period.

For example, the display part 110 includes a first area A1 and a second area A2 and the second area A2 is preset as a sensing area. A location of the sensing area in the display part 110 may be preset variously and be changed by at least one frame.

Referring to FIGS. 1, 4, and 9B, in the sensing period, a method of driving the organic light emitting display device is explained.

The signal generator 140 receives a display enable signal D_EN and a sensing enable signal S_EN from the timing controller 120 (Step S110).

For example, in the sensing period, the sensing enable signal S_EN is activated and the display enable signal D_EN is deactivated. When the signal generator 140 receives the sensing enable signal S_EN which is activated (Step S220), the signal generator 140 generates a start vertical signal STV, a plurality of clock signals CLK1 and CLK2 and a plurality of sensing OE signals S_OE1 and S_OE2 (Step S230).

The scan driver 150 receives the start vertical signal STV, the plurality of clock signals CLK1 and CLK2 and the plurality of sensing OE signals S_OE1 and S_OE2.

The scan driver 150 starts an operation based on the start vertical signal STV.

The scan driver 150 may generate the scan signal and the sensing scan signal based on the plurality of clock signals CLK1 and CLK2.

The scan driver 150 generates a plurality of scan signals S1, S2, S3, . . . , SN in synchronization with a first clock signal CLK1. The plurality of scan signals S1, S2, S3, . . . , SN may have a high voltage period corresponding to a high voltage period of the first clock signal CLK1. The high voltage period is the period with a high voltage H, and the low voltage period is the period with a low voltage L.

The scan driver 150 generates plurality of sensing scan signals SS1, SS2, SS3, . . . , SSN in synchronization with a second clock signal CLK2. The plurality of sensing scan signals SS1, SS2, SS3, . . . , SSN may have a high voltage period corresponding to a high voltage period of the second clock signal CLK2. The second clock signal CLK2 may have a delay difference from the first clock signal CLK1.

A frame period may include first to N-th odd numbered horizontal periods Ho1 to HoN corresponding to the first to N-th scan signals S1 to SN and first to N-th even numbered horizontal periods He1 to HeN corresponding to first to N-th sensing scan signals SS1 to SSN.

In an embodiment, the sensing area corresponds to the second area A2 of the display part. The first sensing OE signal S_OE1 may have (k+1)-th to N-th even numbered horizontal periods He(k+1) to HeN corresponding to (k+1)-th to N-th sensing scan signals SSk+1 to SSN in the second area A2, and each of the (k+1)-th to N-th even numbered horizontal periods He(k+1) to HeN may have a high voltage period having a high voltage H. The first sensing OE signal S_OE1 may have a low voltage L in remaining horizontal periods of the frame period except for the (k+1)-th to N-th even numbered horizontal periods He(k+1) to HeN. The remaining horizontal periods of the frame period include first to N-th odd numbered horizontal periods Ho1 to HoN.

The scan driver 150 may control an output of the plurality of scan signals S1, S2, S3, . . . , SN based on a logical operation of the plurality of sensing OE signals S_OE1 and S_OE2.

For example, the scan driver 150 operates the first and second sensing OE signals S_OE1 and S_OE2 using an AND logical operator. As a result, the AND logical operated signal may have the low level in all first to N-th odd numbered horizontal periods Ho1 to HoN. Therefore, the scan driver 150 may control the plurality of scan signals S1, S2, S3, . . . , SN into the low voltage L based on an AND logical operation of the first and second sensing OE signals S_OE1 and S_OE2.

The scan driver 150 may control an output waveform of the plurality of sensing scan signals SS1, SS2, . . . , SSN based on the AND logical operation of the first and second sensing OE signals S_OE1 and S_OE2.

For example, in the first to k-th even numbered horizontal periods He1 to Hek corresponding to the first area A1, the first and second sensing OE signals S_OE1 and S_OE2 have the low voltage L and thus the AND logical operated signal may have the low level in all first to k-th even numbered horizontal periods He1 to Hek. Therefore, the scan driver 150 controls the first to k-th sensing scan signals SS1 to SSk into the low voltage L in the first to k-th even numbered horizontal periods He1 to Hek using the AND logical operation of the first and second sensing OE signals S_OE1 and S_OE2. The number k is a natural number equal to or smaller than N.

However, in the (k+1)-th to N-th even numbered horizontal periods He(k+1) to HeN corresponding to the second area A2 that is the sensing area, the first sensing OE signal S_OE1 has the high voltage H, and the second sensing OE signal S_OE2 has the low voltage. Thus, the AND logical operated signal may have the high level in all (k+1)-th to N-th even numbered horizontal periods He(k+1) to HeN. Therefore, the scan driver 150 controls the (k+1)-th to N-th sensing scan signals SSk+1 to SSN into the high voltage H in the (k+1)-th to N-th even numbered horizontal periods He(k+1) to HeN using the AND logical operation of the first and second sensing OE signals S_OE1 and S_OE2.

Therefore, the scan driver 150 generates the (k+1)-th to N-th sensing scan signals SSk+1 to SSN having the high voltage H corresponding to the second area A2 that is the sensing area, and sequentially outputs the (k+1)-th to N-th sensing scan signals SSk+1 to SSN to (k+1)-th to N-th sensing scan lines SSLk+1 to SSLN in the second area A2 (Step S240).

The scan driver 150 outputs the first to N-th scan signals S1 to SN having the low voltage L to the first to N-th scan lines SL1 to SLN, and outputs the first to k-th sensing scan signals SS to SSk having the low voltage L to the first to k-th sensing scan lines SSL1 to SSLk in the first area A1 (Step S240).

The sensing driver 160 may receive the sensing signals from the pixel circuits in the second area A2 of the display part 110 in response to the (k+1)-th to N-th sensing scan signals SSk+1 to SSN through the plurality of sensing lines SDL1, SDL2, . . . , SDLM (Step S250).

Therefore, in the sensing period, the sensing OE signal for activating the only sensing scan lines of the second area A2 is generated and thus, the sensing signal is received from the only pixel circuits of the second area A2 based on the sensing OE signal.

According to the embodiments, the sensing OE signal for activating the only sensing scan lines of the sensing area in the display part is generated and thus, the sensing signal is received from the only pixel circuits of the sensing area based on the sensing OE signal. Therefore, a decoder for activating the sensing scan lines of the sensing area is omitted and thus, the scan driver is simplified.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of the inventive concept and is not to be construed as limiting thereof. Although a few embodiments of the inventive concept have been described, those skilled in the art will readily appreciate that many modifications are possible in the embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific embodiments disclosed, and that modifications to the disclosed embodiments, as well as other embodiments, are intended to be included within the scope of the appended claims. The inventive concept is defined by the following claims, with equivalents of the claims to be included therein.

What is claimed is:

1. A method of driving a display device having a plurality of pixel circuits each comprising a driving transistor, a storage capacitor electrically connected to the driving transistor, an organic light emitting diode electrically connected to the driving transistor, a switching transistor electrically connected to the driving transistor and a data line, with a gate electrode of the switching transistor being connected to a scan line, and a sensing transistor electrically connected to the organic light emitting diode and a sensing line, with a gate electrode of the sensing transistor being connected to a sensing scan line, the method comprising:

generating a display output enable (OE) signal having a plurality of first pulses during an image display period in which the pixel circuits perform a light emitting operation;

providing scan signals for turning on the switching transistors for a data voltage applied to the data line to be stored in the storage capacitor in response to the first pulses of the display OE signal during the image display period;

providing sensing scan signals for turning on the sensing transistors for an initial voltage applied to the sensing line to be applied to the organic light emitting diode in response to the first pulses of the display OE signal during the image display period;

generating a sensing OE signal having a plurality of second pulses during a sensing period in which at least some of the pixel circuits perform a sensing operation, the number of second pulses being less than the number of first pulses;

providing scan signals for turning off the switching transistors in response to the second pulses of the sensing OE signal during the sensing period; and providing at least some of the sensing scan signals for turning on at least some of the sensing transistors for a sensing signal at an anode of the organic light emitting diode to be applied to the sensing line in response to the second pulses of the sensing OE signal during the sensing period.

2. The method of claim 1, wherein the scan signals for turning on the switching transistors are sequentially output to all of the scan lines for the light emitting operation during the image display period.

3. The method of claim 1, wherein the scan signals for turning off the switching transistors are output to all of the scan lines for the sensing operation during the sensing period.

4. The method of claim 1, wherein the sensing scan signals for turning on the sensing transistors are sequentially output to all of the sensing scan lines for the light emitting operation during the image display period.

5. The method of claim 1, wherein the at least some of the sensing scan signals for turning on the at least some of the sensing transistors are sequentially output to corresponding ones of the sensing scan lines for the sensing operation during the sensing period.

6. The method of claim 1, wherein a sensing area of the display device is preset to include at least one pixel row, and the sensing signal is received from the pixel circuit in the at least one pixel row.

7. The method of claim 6, wherein a location of the sensing area of the display device is changed by at least one frame.

8. The method of claim 1, wherein the switching transistor comprises the gate electrode connected to the scan line, a first electrode connected to the data line, and a second electrode connected to a gate electrode of the driving transistor.

9. The method of claim 8, wherein the sensing transistor comprises the gate electrode connected to the sensing scan line, a first electrode connected to a second electrode of the driving transistor and the anode of the organic light emitting diode, and a second electrode connected to the sensing line.

10. The method of claim 9, wherein the data voltage applied to the data line is applied to the gate electrode of the driving transistor during the image display period, and wherein the initial voltage applied to the sensing line is applied to the anode of the organic light emitting diode during the image display period.

* * * * *